United States Patent [19]

Lieffers

[11] 4,183,682

[45] Jan. 15, 1980

[54] MOTIONLESS MIXER AND METHOD FOR REMOVING SCALED MIXING ELEMENTS THEREFROM

[75] Inventor: William C. Lieffers, Fullerton, Calif.

[73] Assignee: Union Oil Company of California, Los Angeles, Calif.

[21] Appl. No.: 932,436

[22] Filed: Aug. 10, 1978

[51] Int. Cl.[2] ..... B01F 5/06

[52] U.S. Cl. ..... 366/339

[58] Field of Search ..... 366/336–340

[56] References Cited

U.S. PATENT DOCUMENTS

| | | | |
|---|---|---|---|
| 1,741,019 | 12/1929 | Harrington | 366/338 X |
| 3,206,170 | 9/1965 | Schippers et al. | 366/340 |
| 3,460,809 | 8/1969 | Hauss | 366/338 |
| 3,550,912 | 12/1970 | Melnikov et al. | 366/339 |
| 3,635,444 | 1/1972 | Potter | 366/339 |
| 4,053,141 | 10/1977 | Gussefeld | 366/339 |

FOREIGN PATENT DOCUMENTS

| | | | |
|---|---|---|---|
| 686890 | 5/1964 | Canada | 336/336 |

*Primary Examiner*—Edward L. Roberts

*Attorney, Agent, or Firm*—Dean Sandford; Daniel R. Farrell

[57] ABSTRACT

An inline motionless mixer for mounting in a fluid-conducting conduit having a removable housing which facilitates cleaning of the internal mixing elements.

5 Claims, 3 Drawing Figures

MOTIONLESS MIXER AND METHOD FOR REMOVING SCALED MIXING ELEMENTS THEREFROM

BACKGROUND OF THE INVENTION

This invention relates to fluid mixers, and more particularly to inline motionless mixers.

A myriad of processes require constituents to be mixed together to achieve a resultant uniform, homogeneous dispersion. Many prior art in-line mixers utilize shear and turbulence to effectuate such mixing. As a result, constituents may deteriorate and the degree of mixing achieved will vary widely.

In response to the need for an improved in-line mixer, the "motionless" mixer was developed. The motionless mixer is a fixed, in-line mixer comprising a plurality of mixing elements contained within a tubular housing. These mixing elements achieve the desired mixing by flow inversion (particle flow to and from the center of the mixer and from and to the wall of the housing), flow division (splitting and recombination of flow streams through the mixer), flow reversal, and/or flow rotation. Various mixing elements have been utilized including, inter alia, right and left-handed helices and tetrahedral chambers in fluid communication with each other. These elements are inserted within a tubular housing and held stationary therein by means of welds or retaining rings. In the latter instance, the retaining rings may be removed thereby facilitating axial withdrawal of the mixing elements from the tubular housing for cleaning.

One problem in utilizing a motionless mixer to blend a fluid in chemical equilibria is the resultant deposition of solid deposits and scale which can occur upon distrubing such equilibria by mixing. Scale tends to accumulate at the contact points between the mixing elements and the inner surface of the motionless mixer housing thereby bonding the mixing elements to the inner surface. This bond may be sufficient to prevent axial removal of the mixing elements from the mixer housing for cleaning. The complex geometrical configuration of the mixing elements limits insertion of a cleaning device into the housing to only a few inches, thus making the device difficult to clean.

Accordingly, it is an object of the present invention to provide a motionless mixer, the construction of which facilitates cleaning and reuse of the mixing elements.

Another object of the present invention is to provide a housing for an inline motionless mixer which is economical to construct and which is designed to be discarded after removal of the mixing elements therefrom.

These and other objects and advantages of the invention will be apparent from the following detailed description and drawing.

BRIEF SUMMARY OF THE INVENTION

This invention contemplates an inline motionless mixer for mounting in a fluid-conducting conduit. The mixer has a generally cylindrical fluid-tight housing which is split along the axial length thereof. Preferably, the housing is formed by two mating semi-cylindrical shells mounted in abutting relationship so as to define an axial pathway for conducting fluids from an upstream location to a downstream location. Retaining means are provided to releaseably maintain said semi-cylindrical shells in abutting relationship. One or more mixing elements are fixedly positioned in said axial pathway to mix the fluids flowing therethrough.

One end of the mixer is provided with a flange that can be secured to the conduit to maintain the mixer in a fixed position within the conduit and to prevent the flow of fluid past the exterior of the housing.

If excessive amounts of solid deposits and scale occur within the mixer, the mixer can be removed from the conduit and the housing is divaricated along the axial split therein to provide access for withdrawal of mixing element(s) for cleaning.

BRIEF DESCRIPTION OF THE DRAWING

The invention will be more readily understood by reference to the accompanying drawings, wherein like reference numerals refer to like elements throughout, and in which.

DETAILED DESCRIPTION

Figure 1:
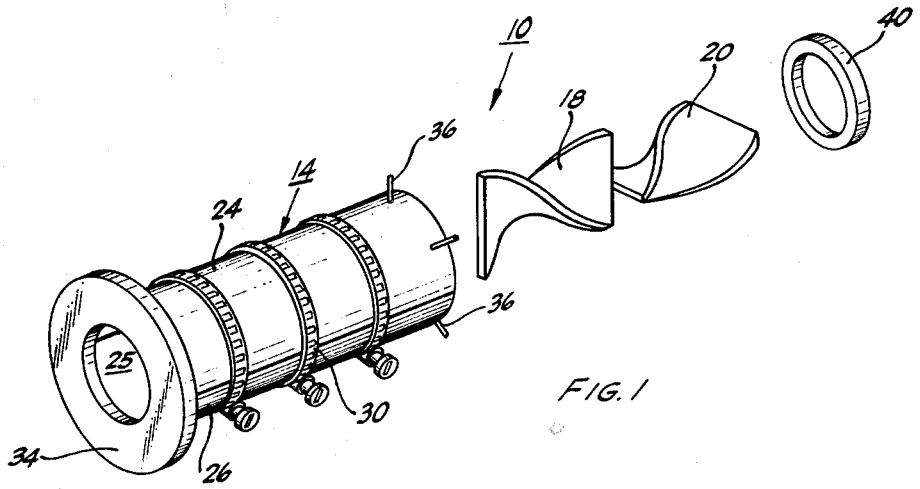
FIG. 1 is an exploded, perspective view of the motionless mixer of the present invention.

Referring now to FIG. 1, the motionless mixer of the present invention is illustrated generally as 10. More particularly, the motionless mixer comprises a housing 14 and a plurality of suitable mixing elements, illustrated as helices 18 and 20, which are inserted into and fixedly positioned within housing 14 in the fully assembled position. Preferably housing 14 is comprised of two semi-cylindrical shells 24 and 26 having identical radii and lengths. These shells are constructed of sheet metal to facilitate access to the mixing elements 18 and 20 for cleaning, as hereinafter described. Alternatively, these shells may be constructed of any suitable material which is relatively inexpensive and relatively pliable. Semi-cylindrical shells 24 and 26 are mated to form a fluid-tight cylindrical housing having an axial pathway 25 therethrough and are fixedly secured in this position by a plurality of bands 30. Bands 30 are constructed of any suitable material, such as a corrosion resistant steel alloy, and are tightened by any suitable means such as, clamps (as illustrated) bolts or latching dog arrangement (not illustrated). The maximum differential pressure between the exterior and interior of housing 14 will determine the number of bands necessary to maintain the housing fluid-tight.

One end of the housing is provided with an annular flange 34 to position the mixer within a conduit, or the like, not shown. The center opening in flange 34 is sized so that the flange uniformly overhangs axial pathway 25 at the end of the housing to which it is secured and thereby defines an annular shoulder of uniform width. A centralizer, illustrated as a plurality of radially extending rods 36, is juxtaposed to the other end of the housing opposite from flange 34. Rods 36 are uniformly spaced about the circumference of housing 14 and extend an equal distance, which is the distance between the outer surface of the housing and the inner surface of the conduit into which the mixer is placed. These rods center and stabilize the unsecured end of housing 14 within the conduit into which the housing is placed. The annular flange 34 and rods 36 can be attached to the housing by any suitable means, such as by welding.

A stop, such as annular ring 40, is juxtaposed to the other end of the housing and is secured to the inner surface thereof by any suitable means such as, for example, welds or bolts (not illustrated). The annular ring defines an annular shoulder which, along with the annular shoulder provided by the overhang of flange 34, restrains axial movement of the mixing elements within the housing. Thus, the length of the housing, the length of the mixing elements, and the size of the annular ring 40 must be chosen such that there is no axial movement between the mixing elements when they are inserted into the housing 14. The mixing elements are secured against rotation within the housing by any suitable means such as, for example, by welds or stop lugs (not illustrated). It is important to note that the mixing elements are sized to contact the inner surface of housing 14 and bridge axial pathway 25 to insure division and mixing of the entire amount of fluid which flows therethrough.

Figure 2:
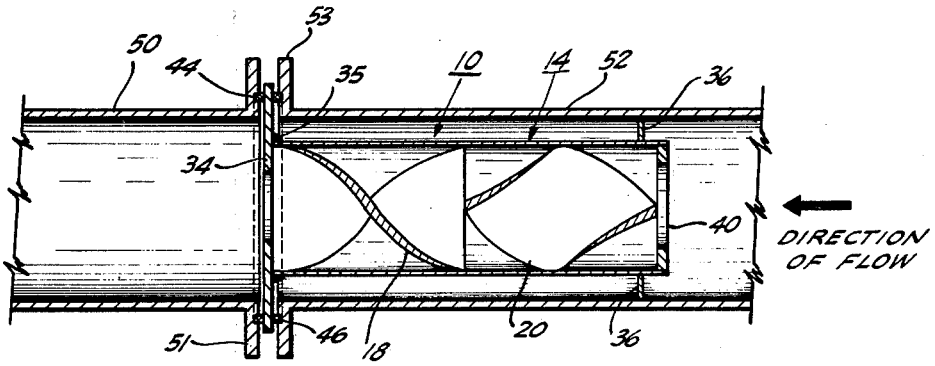
FIG. 2 is a cross-sectional view of the motionless mixer of the present invention as installed in a flow conduit.

Referring now to FIG. 2, the motionless mixer of the present invention is shown in cross-sectional view as fully assembled (i.e., mixing elements fixedly secured in the housing) and positioned within a flow-conducting conduit. As illustrated, annular flange 34 is attached to one end of the housing 14 by means of welds 35. The mixing elements, again illustrated as helices 18 and 20, are secured against axial movement within housing 14 by flange 34 which uniformly overhangs axial pathway 25 at one end thereof, and by annular ring 40 juxtaposed to and positioned within the other end of the housing. The individual mixing elements are sized such that in the fully assembled position within housing 14, the elements abut one another (as illustrated) to insure that no axial movement thereof occurs. The outer peripheries of both sides of flange 34 are provided with annular seal rings 44 and 46. Flange 34 is positioned between flanges 51 and 53 of flow-conducting conduits 50 and 52 respectively. Conduits 50 and 52 are secured together by any suitable means, such as by bolts extending through the flanges 51 and 53 (not illustrated). Annular seal rings 44 and 46 abut flanges 51 and 53 respectively thereby maintaining a fluid-tight seal between adjacent conduits. Seal rings 44 and 46 are constructed of any appropriate resilient material, such as, for example, rubber. Radially extending rods 36 maintain the mixer 10 centralized within conduit 52 and secure the mixer against radial and rotational movement.

Although, as illustrated the center opening in annular flange 34 is downstream from the mixing elements 18 and 20, the relative orientation of the motionless mixer in the flow stream is immaterial to the mixing efficiency thereof, and therefore, the center opening in annular flange 34 may be positioned upstream from the mixing elements.

One method of installing the mixer 10 into a fluid-conducting conduit is to insert the mixer through the annular opening at one end of conduit 52 until annular seal ring 46 abuts flange 53 of conduit 52. The adjoining section of conduit, illustrated as 50, is axially aligned with conduit 52 and is positioned such that annular seal ring 44 on flange 34 abuts flange 51 of conduit 50. Thereafter, conduits 50 and 52 are fixedly secured together, such as by bolting flanges 51 and 53 together.

Figure 3:
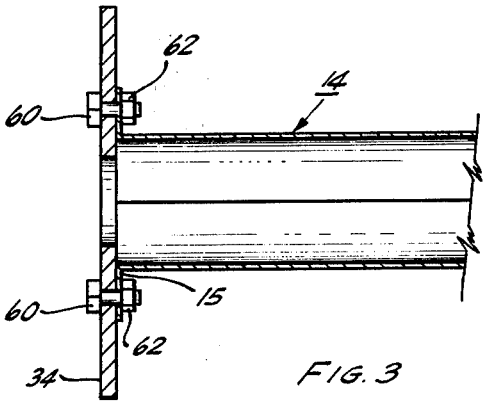
FIG. 3 is a cross-sectional view of an alternative mode of mounting the annular flange to the housing.

A preferred method of mounting the annular flange 34 to one end of housing 14 is illustrated in FIG. 3. In this embodiment, housing 14 terminates at one end with a radially extending, annular shoulder 15. The annular flange 34 is releasably secured to annular shoulder 15 by means of a plurality of bolts 60 and corresponding nuts 62. Alternatively, any other suitable means can be employed to releasably secure flange 34 to shoulder 15, such as, for example, rivets, screws or the like.

Turning to the operation of the motionless mixer of the present invention, such operation will be described with reference to oxidation of hydrogen sulfide present in produced geothermal brine. However, it is not intended that the scope of the present invention be limited to such process, but the motionless mixer of the present invention may be utilized in mixing any fluids in which the deposition of solids and scaling occur as a result of such mixing.

An oxidant (i.e., air) is injected into geothermal brine flowing through conduit 52 upstream of the motionless mixer 10 by any suitable means, such as by an injection nozzle (or plurality thereof) which extends through the wall of conduit 52 (not illustrated). The oxidant and geothermal brine flow through conduit 52 until flange 34 and seal ring 46 divert the flow thereof through the opening in annular ring 40 and into axial pathway 25. The oxidant and brine are thoroughly mixed upon passing through the mixing elements. Although illustrated as helices, any mixing element geometry which achieves the desired degree of mixing may be utilized. After passing through the motionless mixer, the oxygenated brine flows through the opening in flange 34 and into conduit 50.

When mixing an oxidant with geothermal brine to oxidize the sulfide present in the brine, several varieties of solids and scale may be deposited. Examples of these are barium sulfate, iron pyrite, heavy and/or transition metal sulfides, and carbonate scale. Such deposition and scaling will occur not only on the mixing elements but also on the inner surface of housing 14 and, in particular, where the mixing elements contact the inner surface. As a result, such deposition and scaling often bonds the mixing elements to the inner surface of the housing rendering axial removal of the mixing element for cleaning purposes virtually impossible. If unchecked, the deposition and scaling will eventually build up to the point where fluid flow through the motionless mixer is completely blocked. During such buildup the mixing efficiency of the motionless mixer is greatly reduced.

In such instances, axial removal of the mixing elements from the housing of the motionless mixer of the present invention is virtually impossible, and flow of geothermal brine through the mixer 10 is terminated and the mixer is removed from the flow conduit. Bands 30 are relaxed and removed from around housing 14. Flange 34 and annular ring 40 are also removed from the housing. Thereafter, housing 14 is spread apart along the juncture of shells 24 and 26 to allow for removal of the mixing elements from the housing. Once the mixing elements are removed, deposition and scale are cleaned therefrom by sandblasting, acid cleaning, or other suitable means. Thus, the relatively inexpensive housing readily provides access to clean the scaled mixing elements. The mixer is then assembled as aforedescribed utilizing the cleaned mixing elements, the removed annular ring and flange, and new semi-cylindrical shells 24 and 26, the removed shells usually being discarded.

Even though the fluid-tight housing of the motionless mixer of the present invention has been described as preferably being comprised of two mated semi-cylindrical shells, the housing may be constructed in any suitable manner which provides for a fluid-tight cylindrical housing being split along the axial-length thereof and having an axial pathway therethrough. As an example of such construction, the housing may be formed of one piece of sheet metal, rolled into the shape of a cylinder. The housing may be divaricated along the split therein to allow for removal of the mixing elements.

When utilized in a corrosive environment, the useful life of all the permanent components of the motionless mixer of the present invention may be preserved by constructing these components of an alloy which is resistent to corrosion, or coating these components with a corrosion resistant material. An example of a suitable alloy is a titanium alloy, and a suitable corrosion resistant coating is CorReco 700, a phenol mercaptide, marketed by Corrosion Research Company.

It can thus be seen that the motionless mixer of the present invention provides an efficient and economical means for facilitating removal of mixing elements from the mixer, when deposition and scaling prevent axial removal therefrom.

While various embodiments and modifications of this invention have been described in the foregoing description, further modifications will be apparent to those skilled in the art. Such modifications are included within the scope of this invention as defined by the following claims.

I claim:

1. An in-line motionless mixer mounted in a fluid-conducting conduit, comprising:

a generally cylindrical, fluid-tight housing having a first end and an opposed second end and formed by two semi-cylindrical shells mated in abutting relationship thereby defining an axial pathway therethrough for conducting fluids, said shells being constructed of sheet metal;

a plurality of bands releasably tightened around said housing to maintain said housing fluid-tight;

at least one mixing element fixedly positioned within said axial pathway to mix the fluid flowing therethrough;

an annular flange releasably mounted at said first end of said housing, said annular flange being sized to secure said mixer in the conduit and to prevent axial removal of said mixing element through said first end of said housing;

a stop fixedly positioned within said housing and juxtaposed to said second end of said housing opposite said first end, said stop preventing axial removal of said mixing element from said second end of said housing; and a plurality of radially extending rods mounted on the outer surface of said housing so as to center and stabilize said housing within said conduit.

2. An in-line motionless mixer mounted in a fluid-conducting conduit, comprising:

a generally cylindrical, fluid-tight housing having a first end and an opposed second end and formed by two semi-cylindrical shells mated in abutting relationship thereby defining an axial pathway therethrough for conducting fluids;

retaining means for releasably maintaining said semi-cylindrical shells in fluid-tight abutting relationship;

at least one mixing element fixedly positioned within said axial pathway to mix the fluid flowing therethrough;

flange means releasably mounted at said first end of said housing, said flange means being sized to secure said mixer in the conduit and to prevent axial removal of said mixing element through said first end of said housing;

stop means fixedly positioned within said housing and juxtaposed to said second end of said housing opposite said first end, said stop means preventing axial removal of said mixing element from said second end of said housing; and means mounted on said housing for centering and stabilizing said housing within said conduit.

3. The apparatus defined in claim 2 wherein said retaining means comprises a plurality of bands operably connected to means for releasably tightening said bands.

4. The apparatus defined in claim 2, wherein said means for centering and stabilizing comprises a plurality of radially extending rods of uniform length mounted on the outer surface of said generally cylindrical housing.

5. The apparatus defined in claim 2 wherein said housing is constructed of sheet metal.

* * * * *